US005520506A

United States Patent [19]

Luthi

[11] Patent Number: 5,520,506

[45] Date of Patent: May 28, 1996

[54] PULP SLURRY-HANDLING, CENTRIFUGAL PUMP

[75] Inventor: Oscar Luthi, Nashua, N.H.

[73] Assignee: Ingersoll-Rand Company, Woodcliff Lake, N.J.

[21] Appl. No.: 279,385

[22] Filed: Jul. 25, 1994

[51] Int. Cl.[6] ..... F04D 29/44

[52] U.S. Cl. ..... 415/58.4; 415/191

[58] Field of Search ..... 415/56.5, 58.4, 415/58.6, 183, 185, 191

[56] References Cited

U.S. PATENT DOCUMENTS

| | | | |
|---|---|---|---|
| 1,210,777 | 1/1917 | Entwisle | 415/191 |
| 2,202,790 | 5/1940 | Forrest | 415/185 |
| 2,240,782 | 5/1941 | Jacobsen | 415/191 |
| 3,221,661 | 12/1965 | Swearingen | 415/191 |
| 3,384,022 | 5/1968 | Oshima | 415/191 |
| 4,492,516 | 1/1985 | McCoy, Jr. | 415/58.4 |
| 4,637,779 | 1/1987 | Sherman et al. . | |
| 4,721,435 | 1/1988 | Kuah | 415/183 |
| 4,770,604 | 9/1988 | Luthi et al. . | |

FOREIGN PATENT DOCUMENTS

| | | | |
|---|---|---|---|
| 0297464 | 1/1989 | European Pat. Off. . | |
| 2715113 | 12/1977 | Germany . | |
| 386432 | 1/1933 | United Kingdom | 415/183 |
| 653161 | 5/1951 | United Kingdom . | |

*Primary Examiner*—Edward K. Look
*Assistant Examiner*—James A. Larson
*Attorney, Agent, or Firm*—Robert F. Palermo; Michael H. Minns

[57] ABSTRACT

Deflecting vanes, confronting the blades of the impeller-inducer, and fixed in the housing, inhibit the formation of a vortex upstream of the impeller-inducer. Too, the vanes direct the recirculation flow back into the central zone of the pump. The impeller-inducer is force-fed by its own recirculation.

12 Claims, 2 Drawing Sheets

PULP SLURRY-HANDLING, CENTRIFUGAL PUMP

BACKGROUND OF THE INVENTION

This invention pertains, generally, to centrifugal pumps used in the pulp industry to pump pulp slurries, and in particular to a centrifugal pump of such configuration as renders it capable of handling pulp slurry having up to approximately a fifteen percent consistency for long fibered pulp.

Traditionally, centrifugal pumps have been limited to handling pulp slurries of approximately four percent consistency. For higher consistencies, up to about eighteen percent, positive displacement pumps have been used. In the industry, recent developments by some manufacturers have pushed the limit for centrifugal pumps up to about a twelve percent consistency. Claims of the manufacturers notwithstanding, these pumps actually run in the ten to twelve percent consistency range, depending upon fiber length, and not the up to fifteen percent consistency alleged therefor.

It is very desirable to have a centrifugal pump which can run reliably at the fifteen percent consistency for long fibered pulp for the following reasons:

1. Bleach towers tend to channel at consistencies below fourteen percent, and thus shorten the retention time of the product. This becomes more important as the capacities increase and the bleach towers get larger in diameter.
2. More steam is required to heat a more dilute slurry.
3. Storage tanks are built, at some considerable expense, to store pulp, not water.
4. Typically available infeeding filters discharge at fourteen to fifteen percent consistency. Dilution, then, to render the product acceptable to a receiving centrifugal pump is undesirable involving as it does another, expensive processing procedure.

Centrifugal pumps designed to handle higher consistency (albeit not fifteen percent) pulps incorporate the following design features:

1. A larger diameter infeed section.
2. A pulp inducer with an overfeeding capacity.
3. Non-converging flow passages in the inducer and impeller.
4. Large size flow channels in the inducer and impeller to minimize friction and to allow passage of tramp metal.

These centrifugal pumps, however, have serious defects. The overfeeding inducer recirculates some pulp into the feed area (i.e., regurgitation). The recirculated pulp has a large rotational velocity and causes a strong vortex ahead of the inducer. The vortex increases in intensity as it is drawn towards the eye of the impeller (i.e., as a contracting vortex). This vortex has several disadvantages:

1. Pulp at medium consistency (from ten to fifteen percent) contains a significant amount of air. This air is not harmful if it is evenly dispersed. But, the vortex will centrifuge air out of the suspension. Air will accumulate at the eye of the impeller and air-bind the pump.
2. A feed screw pushes the pulp towards the inducer. In that the feed screw rotates in the same direction as the impeller, the rotating vortex tends to stop or impede the pulp flow in the feed screw. This is depicted in FIG. 1, herein.
3. The vortex creates a low pressure zone at the eye of the impeller; i.e., the suction head of the pump is negative.

4. The vortex consumes unnecessary power.

The foregoing details the limitations and disadvantages known to exist in the prior art. Thus, it is apparent that it would be advantageous to provide an alternative directed to overcoming one or more of the aforesaid limitations and disadvantages. Accordingly, a suitable alternative, embodied in a novel pulp slurry-handling, centrifugal pump, is set forth herein, the same having features more fully disclosed hereinafter.

SUMMARY OF THE INVENTION

In one aspect of the instant invention, the desired alternative is found in a pulp slurry-handling, centrifugal pump, comprising a volute housing; and an impeller-inducer journalled in said housing; wherein said housing has (a) an inlet, and (b) an outlet; and means fixed to said housing, intermediate said inlet and said impeller-inducer, for inhibiting formation of a vortex upstream of said impeller-inducer.

Further aspects of the invention, as well as the novel features thereof, will become apparent by reference to the following description, taken in conjunction with the accompanying figures.

DESCRIPTION OF THE PREFERRED EMBODIMENT

Figure 1:
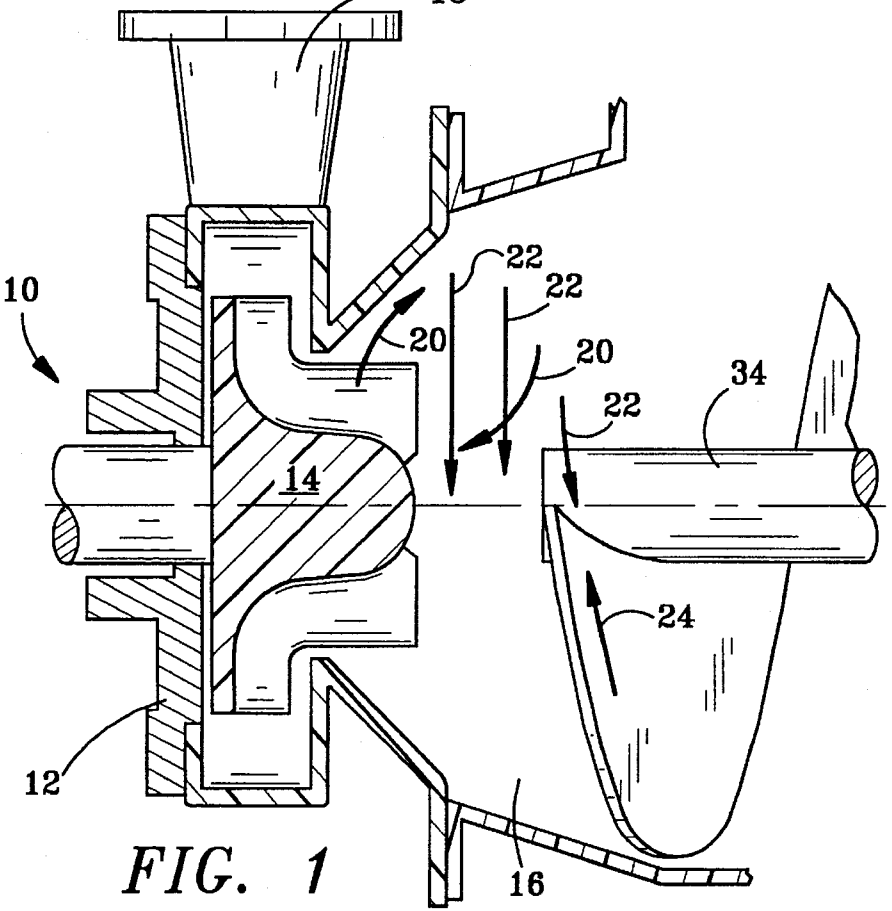
FIG. 1 (PRIOR ART)
FIG. 1 is a side, elevational view, partly cross-sectioned, of a prior art, pulp slurry-handling, centrifugal pump.
Figure 5:
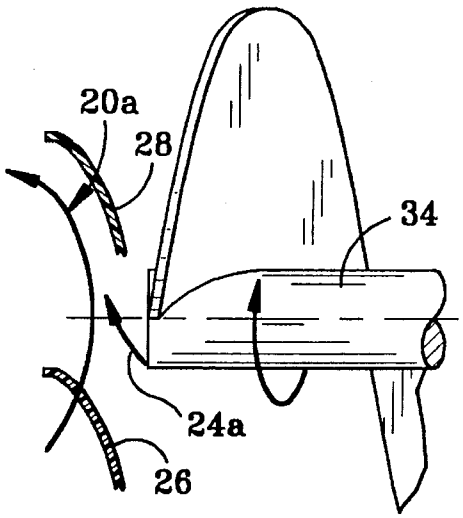
FIG. 5 is a detailed view taken along arcuate section 5—5 of FIG. 3.
Figure 4:
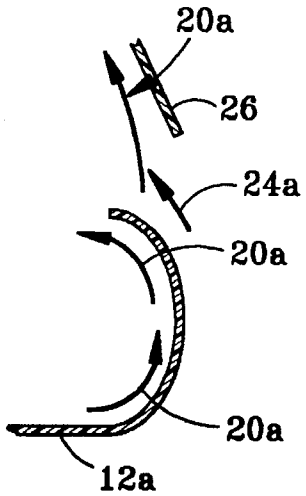
FIG. 4 is a detailed view taken along arcuate section 4—4 of FIG. 3.

FIG. 1 depicts a prior art, pulp slurry-handling, centrifugal pump 10, the same having a volute housing 12, an impeller 14 journalled in the housing, and the housing having a slurry inlet 16 and an outlet 18. The arrows 20 represent the recirculation flow which occurs in the inlet 16, and arrows 22 represent the vortex flow. Finally, arrow 24 represents the relative pulp flow. As can be seen, the pulp flow, arrow 24, must overcome the opposing vortex flow, arrows 22, velocity head.

Figure 2:
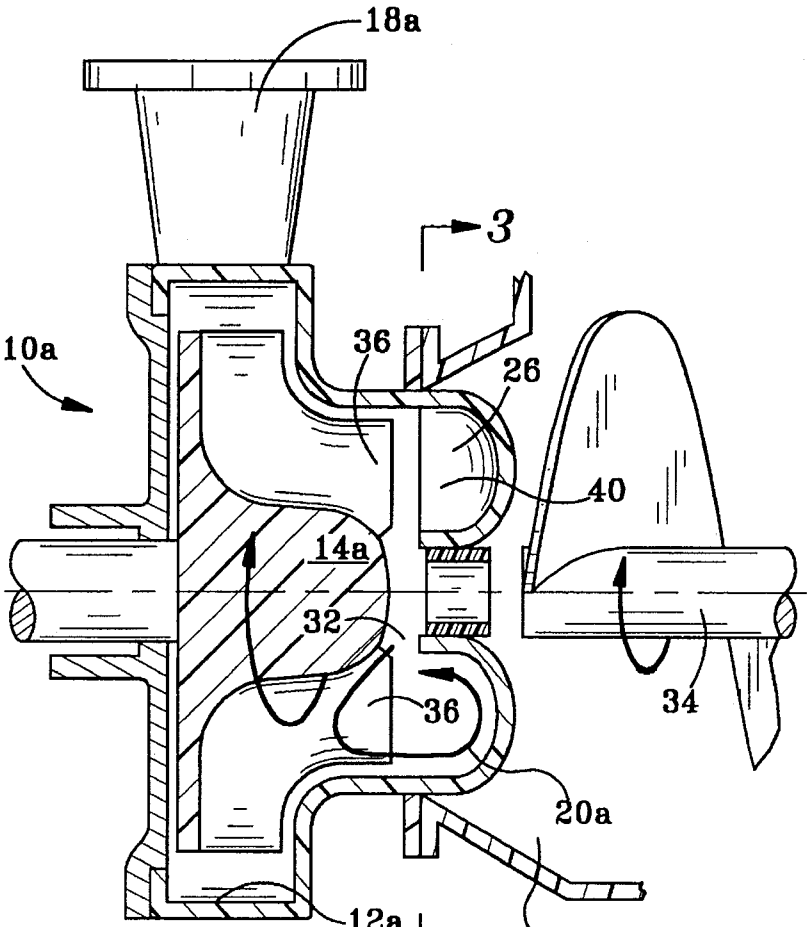
FIG. 2 is a view, like that of FIG. 1, depicting the novel centrifugal pump of the instant invention, according to an embodiment thereof.
Figure 3:
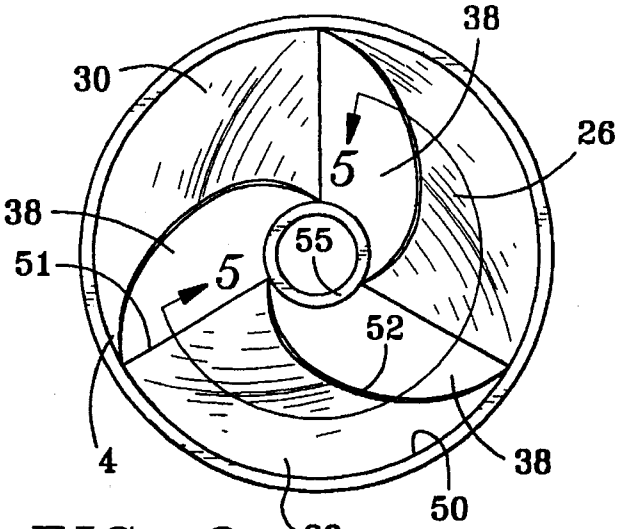
FIG. 3 is a view of the directing vanes, the same taken along section 3—3 of FIG. 2.

The novel centrifugal pump **10*a* shown in FIG. 2, the same being an embodiment of the invention, overcomes the vortex problem. Pump 10*a* has a volute housing 12*a*, with an impeller-inducer 14*a* journalled therein. The housing 12*a* has a slurry inlet 16*a* and an outlet 18*a*. In addition, now, the pump 10*a* has fixed, i.e., stationary, vanes 26, 28 and 30 in the housing 12*a*. Vane 26 is visible in FIG. 2, whereas all three of the vanes are shown in FIG. 3. Arrows 20*a* represent the recirculation flow, in FIGS. 2 through 6. It can be seen that the diversion vanes 26, 28, and 30 deflect the recirculation flow back into the central zone 32 of the housing 12*a*. The impeller-inducer is force-fed by its own recirculation. Too, the recirculation flow, arrows 20*a*, complements the feed pulp flow, shown by arrows 24*a***, as depicted in FIGS.

4 through 6. The circulation conforms with the directional flow of the feed pulp, as supplied by the feed screw 34.

Figure 6:
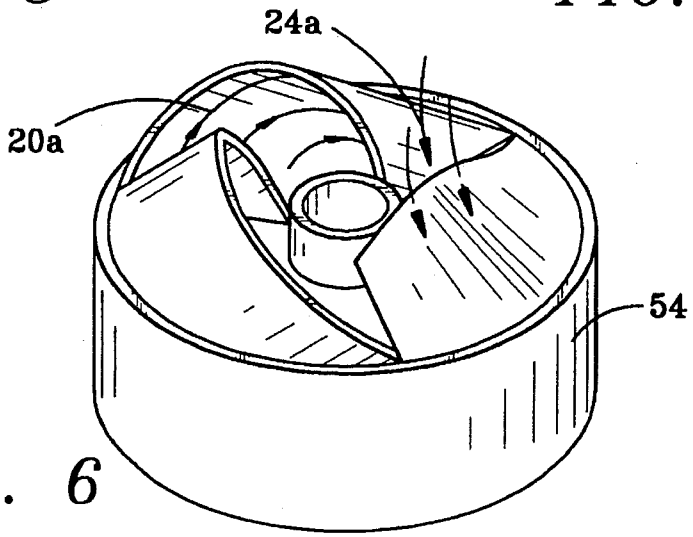
FIG. 6 is a perspective view of the flow deflector of FIGS. 2 and 3.

The vanes 26, 28, and 30 are equally spaced apart, and confront the blades 36 of the impeller-inducer 14*a*. They are radially disposed about the center of the housing 12*a*. The spacing of the vanes 26, 28, and 30 defines openings 38 therebetween for admitting slurry. FIG. 6 shows the pump flow deflector and the paths of feed pulp 24*a* and regurgitated pulp 20*a*.

As shown in FIG. 6, the vanes 26, 28, 30 have a curved three dimensional scoop shape. In addition, the vanes depicted in the FIGURES have three edges 50, 51, 52. The first edge 50 extends circumferentially along a portion of an outer ring 54; the second edge 51 extends from the outer ring 54 to an inner cylinder 55; and the third edge 52 extends from the inner cylinder to the outer ring 54.

As noted, the impeller-inducer 14*a* is force fed by its own recirculation. This creates a highly agitated zone 40 ahead of the impeller-inducer 14*a* in which to fluidize the pulp-air-water mixture. Consequently, a higher consistency of pulp slurry, i.e., up to fifteen percent or so, can enter the pump 10*a* without causing plugging thereof. The pump 10*a* requires no suction head for priming thereof. Too, it starts more easily and can readily handle more air. The power requirements therefor are minimized because the agitated zone 40 is small, and the velocity head is utilized for feeding.

New pulp slurry is pulled into the agitated zone 40 by the recirculation flow (arrows 20*a*). In fact, a feed screw, such as feed screw 34, is not required for consistencies up to approximately twelve percent. For consistencies over twelve percent, the feed screw 34 is beneficial to avoid pulp bridging in the feed chute.

In the prior art there is a centrifugal pump which uses fluidizer vanes on the impeller to induce a vortex ahead of the rotor, and it removes the air with a separate air removal system. However, in this it is most difficult to prevent the air removal system from plugging with pulp fibers. Also, it requires a high feed chute for a high, positive suction head. This is not desirable, because the preceding pulp washer needs to be elevated accordingly. Another prior art centrifugal pump uses a feed screw with an opposite rotation to that of the pump impeller. This kills the vortex, but without utilizing its energy to advantage. Too, feeding of this pump is erratic and uses more power. Finally, another prior art centrifugal pump uses a separately driven fluidizer roll ahead of the pump inlet, with a rotating axis ninety degrees of arc to the impeller axis. This creates a large fluidized zone which absorbs considerably more power. Too, the velocity head of the fluidizing flow is not utilized.

While I have described my invention in connection with a specific embodiment thereof, it is to be understood that this is done only by way of example and not as a limitation to the scope of the invention as set forth in the aspects thereof and in the appended claims.

What is claimed is:

1. A pulp slurry-handling, centrifugal pump, comprising:

a volute housing; and an impeller-inducer journalled in said housing; wherein:

said housing has an inlet, and an outlet; and means fixed to said housing, intermediate said inlet and said impeller-inducer, for inhibiting formation of a vortex upstream of said impeller-inducer, said means comprising a plurality of equally-spaced-apart scoop shaped curved deflector vanes.

2. A pulp slurry-handling, centrifugal pump, according to claim 1, wherein:

said impeller-inducer has a plurality of blades; and said vanes are in confronting relationship to said blades.

3. A pulp slurry-handling, centrifugal pump, according to claim 1, wherein:

said housing has a radial center; and said vanes are radially disposed about said center.

4. A pulp slurry-handling, centrifugal pump, according to claim 1, wherein:

said vanes are equally-spaced-apart, as aforesaid, and define pulp slurry openings therebetween.

5. A pulp slurry-handling, centrifugal pump, according to claim 1, wherein:

said housing has a central zone subsisting generally fore and centrally of said impeller-inducer;

said impeller-inducer comprises means for creating a recirculating flow of pulp slurry within said housing; and said vanes comprises means for deflecting said recirculating flow into said central zone.

6. A pulp slurry-handling, centrifugal pump, according to claim 1, wherein:

said impeller-inducer comprises means for creating a recirculating flow of pulp slurry within said housing; and said vanes comprise means for causing said recirculating flow to force-feed said impeller-inducer.

7. A pulp slurry-handling, centrifugal pump, according to claim 1, wherein:

said vanes comprise means cooperative with said impeller-inducer to create an agitated, fluidized zone, within said housing, in said inlet thereof.

8. A pulp slurry-handling centrifugal pump comprising:

a volute housing having an inlet and an outlet;

an impeller-inducer rotatably mounted within the housing; and a diversion means, fixed to the housing between the inlet and the impeller-inducer, for redirecting recirculation flow of pulp from the impeller-inducer back towards the impeller-inducer, the diversion means comprising a plurality of scoop shaped curved vanes.

9. The pulp slurry-handling centrifugal pump according to claim 8, wherein the curved vanes are spaced apart from one i another defining pulp slurry openings therebetween, the redirected recirculation flow pulling pulp slurry from the housing inlet into the impeller-inducer.

10. The pulp slurry-handling centrifugal pump according to claim 8, wherein the diversion means further comprises an axially extending annular outer ring and an axially extending inner cylinder, the vanes being attached to the outer ring and the inner cylinder, each vane having three edges.,a first edge extending circumferentially along portion of the outer ring, a second edge extending from the outer ring to the inner cylinder and a third edge extending from the inner cylinder to the outer ring.

11. The pulp slurry-handling centrifugal pump according to claim 10, wherein the inner cylinder is an annular ring having a central opening.

12. A pulp slurry-handling centrifugal pump comprising:

a volute housing having an inlet and an outlet;

an impeller-inducer rotatably mounted within the housing; and a diversion means, fixed to the housing between the inlet and the impeller-inducer, for redirecting recirculation flow of pulp from the impeller-inducer back towards the impeller-inducer, the diversion means comprising a plurality of scoop shaped curved vanes, an axially extending annular outer ring and an axially extending inner cylinder ring, the vanes being attached to the outer ring and the inner cylinder, each vane having three edges, a first edge extending circumferentially along a portion of the outer ring, a second edge extending from the outer ring to the inner cylinder and a third edge extending from the inner cylinder to the outer ring, the curved vanes being spaced apart from one another defining pulp slurry openings therebetween, the redirected recirculation flow pulling pulp slurry from the housing inlet into the impeller-inducer.

* * * * *